US009163394B1

(12) United States Patent
Barker

(10) Patent No.: US 9,163,394 B1
(45) Date of Patent: Oct. 20, 2015

(54) PORTABLE VEHICLE COVER STRUCTURE

(71) Applicant: Richard Bruce Barker, College Park, MD (US)

(72) Inventor: Richard Bruce Barker, College Park, MD (US)

( * ) Notice: Subject to any disclaimer, the term of this patent is extended or adjusted under 35 U.S.C. 154(b) by 0 days.

(21) Appl. No.: 14/477,275

(22) Filed: Sep. 4, 2014

(51) Int. Cl.

| | |
|---|---|
| ***E04B 1/12*** | (2006.01) |
| ***E04H 15/00*** | (2006.01) |
| ***E04H 15/18*** | (2006.01) |
| ***E04B 1/343*** | (2006.01) |
| ***E04B 1/41*** | (2006.01) |
| ***E04D 5/06*** | (2006.01) |
| ***E04D 5/14*** | (2006.01) |

(52) U.S. Cl.
CPC ..... *E04B 1/34326* (2013.01); *E04B 1/34384* (2013.01); *E04B 1/40* (2013.01); *E04D 5/06* (2013.01); *E04D 5/144* (2013.01)

(58) Field of Classification Search
CPC ... E04B 1/34326; E04B 1/34384; E04B 1/40; E04B 1/34315; E04B 1/34336; E04D 5/06; E04D 5/144; E04H 6/04; E04H 6/025; E04H 15/06; E04H 15/44; E04H 15/64; B60J 11/00; B60J 11/04
See application file for complete search history.

(56) References Cited

U.S. PATENT DOCUMENTS

| | | | | |
|---|---|---|---|---|
| 2,989,967 | A | 6/1967 | Lee | |
| 3,424,178 | A * | 1/1969 | Yazaki | 135/157 |
| 3,463,174 | A | 8/1969 | Heller | |
| 4,347,690 | A * | 9/1982 | Wallace, Jr. | 52/93.1 |
| 4,558,713 | A * | 12/1985 | Hagler et al. | 135/159 |
| 4,605,030 | A | 8/1986 | Johnson | |
| 4,655,236 | A | 4/1987 | Dorame | |
| 4,769,962 | A * | 9/1988 | Pohl et al. | 52/273 |
| 4,944,321 | A | 7/1990 | Moyet-Ortiz | |
| 5,579,796 | A | 12/1996 | Mallo | |
| 5,660,005 | A * | 8/1997 | Tacoma | 52/93.2 |
| 5,709,238 | A * | 1/1998 | Mattioli | 135/87 |
| 6,263,895 | B1 * | 7/2001 | Bang | 135/138 |
| 6,994,099 | B2 * | 2/2006 | Goldwitz | 135/122 |
| 7,770,591 | B2 * | 8/2010 | Tseng | 135/122 |
| 8,522,806 | B2 * | 9/2013 | Li | 135/120.3 |
| 8,607,810 | B1 * | 12/2013 | Chung | 135/88.06 |
| 2005/0224105 | A1 * | 10/2005 | Yang | 135/88.07 |
| 2007/0079855 | A1 * | 4/2007 | Li | 135/87 |
| 2014/0331591 | A1 * | 11/2014 | Ohlson | 52/653.2 |

* cited by examiner

*Primary Examiner* — Brian D Mattei

(57) ABSTRACT

A portable or moveable carport is described. The carport as described herein is able to be quickly and easily set up and taken down while still shielding a vehicle from rain, snow and sun—the primary destroyers of automotive paint, body and interiors. The structure has at least four vertical legs supporting an A-frame roof structure. The vertical legs are anchored under the vehicle's four tires with adjustable plates which can be driven onto once the structure is assembled.

17 Claims, 6 Drawing Sheets

FIG. 8

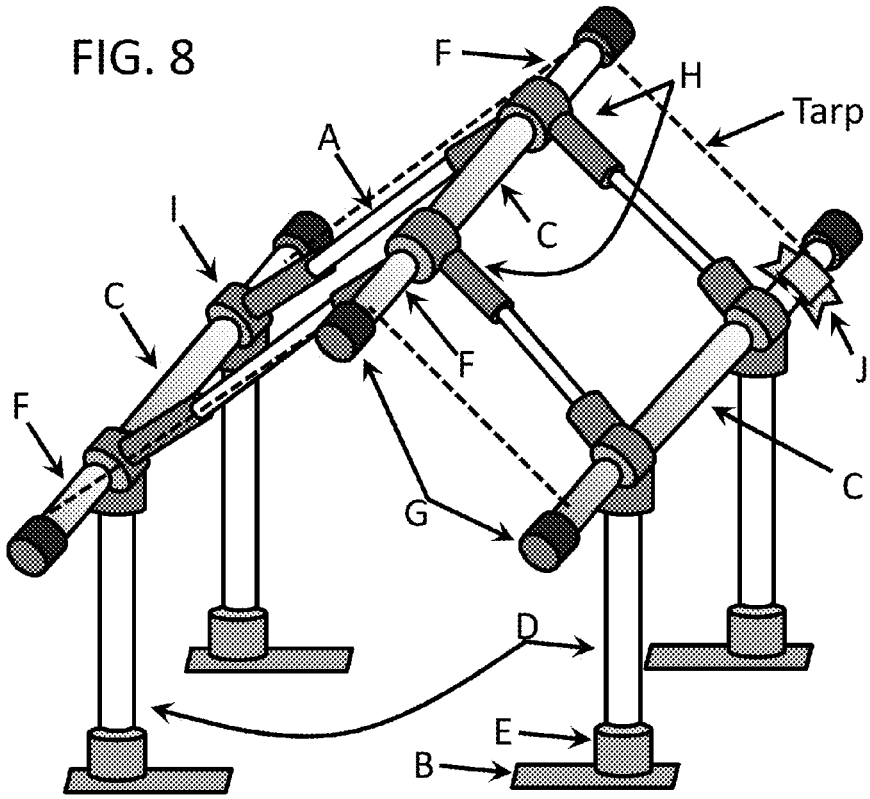

| Label | Name | No. pieces | Length |
|---|---|---|---|
| A | End Roof Rafters | 4 | 4'x1" Pipe |
| B | "Paws" Diamond Embossed Finish | 4 | 10"x24"x0.125" Aluminum Plate |
| C | Ctr Roof Ridge and Side Pipe | 3 | 9.4'x1" Pipe |
| D | Leg Pipe (Note 1) | 4 | 6'x1" Pipe |
| E | Foot Pad | 4 | 6"x4" |
| F | Outer Roof Ridge Pipe | 6 | 4'x1" Pipe |
| G | Rubber Pipe End Bumper | 6 | 2"x1.1" |
| H | Center Four Pipe Hole Fitting | 2 | 12"x4" |
| I | Side Four Hole Pipe Fitting | 4 | 12"x12" |
| J | Black Ball Ties | 20 | 6" |

Note 1: Legs can be cut to any desired length. Structures with side height greater than 8 feet should only be constructed with 1 3/8 inch tubing materials.

FIG. 8 (cont.)

Approximate Final Dimensions:
These are approximate final dimensions. They may vary slightly with variations in cut lengths, tarp variations and assembly

| | |
|---|---|
| Tarp Size | 17.4'x8' |
| Peak Height | 6.5' |
| Side Height | 6' |
| Front Opening Width | 8'x6.5' |
| Tarp Color | Optional |
| Overall length | 17.8' |

PORTABLE VEHICLE COVER STRUCTURE

FIELD

The invention relates generally to a vehicle storage unit and more particularly to a portable or moveable carport. Embodiments as described herein are able to be quickly and easily set up and taken down while still shielding a vehicle from rain, snow and sun—the primary destroyers of automotive paint, body and interiors.

BACKGROUND

An automobile, boat, or other vehicle is a sizable investment to most consumers. Collector cars are a popular investment, but many owners do not have expensive garages, carports or other storage means readily available to protect their vehicles from the elements. Fabric and plastic car covers are available, but car covers that are not breathable or let moisture through, can cause severe damage to a vehicle's finish if water is trapped under the cover. Good breathable car covers are expensive and can still chafe the car's finish, and also allow water or dust to penetrate. Additionally, car covers are unwieldy, tend to wear out quickly and can be damaged by UV radiation or adverse weather. As a solution, heavy carports are available, but they suffer from the need to be attached to the ground via lag bolts, ropes, or other mechanical means to make them at least semi-permanent. Portable shelters are usually complicated in design, are susceptible to collapse due to their lightweight structure, and most importantly, difficult to manufacture. As a result, these protective portable devices have not received any commercial success.

SUMMARY

Described herein is a portable or moveable carport that is able to be quickly and easily set up and taken down, is able to structurally withstand high winds and foul weather, and shield a vehicle from rain, snow and sun—the primary destroyers of automotive paint, body and interiors. The structure has no more than four vertical supports supporting an A-frame roof structure. The vertical legs are anchored under the vehicle's four tires with adjustable two piece anchor plates which can be driven onto once the structure is assembled. A fabric or plastic roof provides protection from the elements, and sides, front, and back may be additionally added to the carport.

A first aspect comprises a carport comprising no more than four anchor plates, wherein each plate comprises a plate that sits on the ground and may be placed under the wheels of a vehicle, no more than four vertical elements that are connected to the four foot pads inserted up through a whole in each anchor plates, a roof structure comprising two transverse elements that are approximately parallel to each other and the ground and each connect two vertical elements to each other, a single peak element that is approximately parallel to the transverse elements and the ground, four connecting elements, wherein two of each connecting element connect the peak element to a transverse element. Both the two transverse elements and the single peak rafter element always extend beyond the vertical elements area making a larger roof area than the vertical elements area. The transverse elements and the peak element are able to be dissembled into sub-sections of length no greater than five feet. In some embodiments, the anchor plates are able to be rotated around the axis formed by the vertical elements, for example the anchor plates are able to be rotated over an angle of about 160 degrees.

The roof pitch in some cases may be from about 1/12 to about 18/12. The roof element may comprise any material, but in some cases it is fabric, plastic or combination thereof. In embodiments, roof element is attached to the transverse elements by wire, flexible or fixed ties, rope, zip ties, buttons, zippers, or hook and eye elements. In some designs, the carport further comprises side elements that comprise a fabric, plastic, or combination thereof, and wherein the side elements attach to the vertical elements and the transverses elements.

The carport may further comprise a first sleeve element comprising a sleeve structure with openings for the vertical element, the transverse element, and the connecting element and/or a second sleeve element comprising a sleeve structure with openings for the connecting element and the peak element.

In a particular embodiment of the carport, the anchor plates comprise aluminum, the vertical elements, the transverse elements, the peak element, and the connecting elements, and the first and second sleeve elements all comprise aluminum, steel, iron, plastic, fiberglass or carbon fiber.

Other aspects and modes of the invention will be apparent from the following description and the appended claims.

BRIEF DESCRIPTION OF DRAWINGS

The accompanying drawings, described below, illustrate typical embodiments of the invention and are not to be considered limiting of the scope of the invention, for the invention may admit to other equally effective embodiments. The figures are not necessarily to scale, and certain features and certain views of the figures may be shown exaggerated in scale or in schematic in the interest of clarity and conciseness.

FIG. 8 provides example specifications for a carport embodied herein.

DETAILED DESCRIPTION

Figure 1:
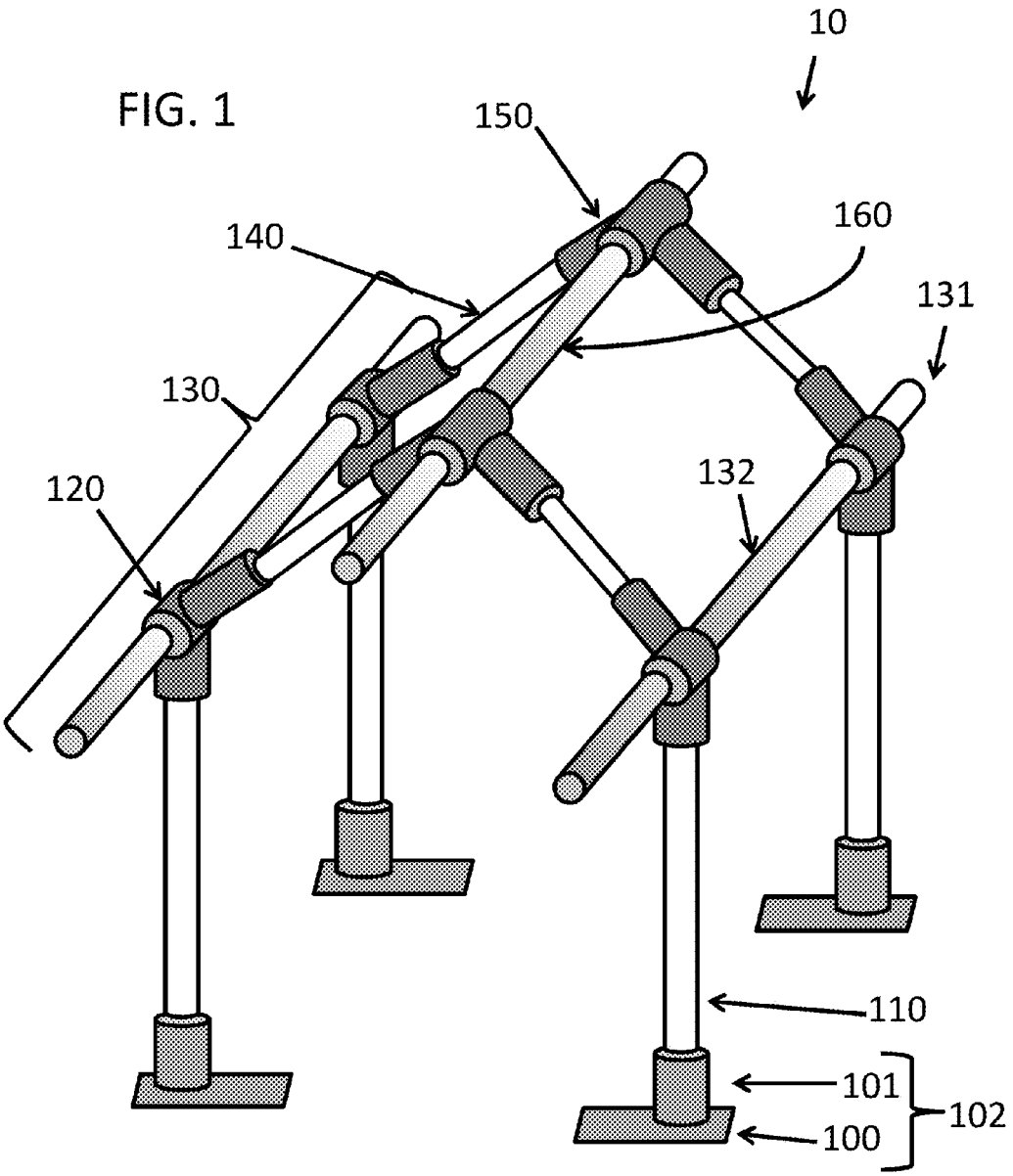
FIG. 1 is a schematic representation of an embodiment described herein.

Aspects will now be described in detail with reference to embodiments, as illustrated in the accompanying drawings. In describing the embodiments, numerous specific details are set forth in order to provide a thorough understanding. However, it will be apparent to one skilled in the art that embodiments may be practiced without some or all of these specific details. In other instances, well-known features and/or process steps have not been described in detail so as not to unnecessarily obscure the description. In addition, like or identical reference numerals are used to identify common or similar elements.

The following describes a portable or moveable carport that provides the following advantages: it is able to be quickly and easily set up and taken down, it is able to structurally withstand high winds and foul weather, and critically, it is able to shield a vehicle from the primary destroyers of automotive paint, body and interiors—rain, snow and sun. Further, the carport is secured to the ground without the need for rope, wire or other types tie downs or other external devices that are secured in the ground and take up additional space outside of the carport.

Figure 2:
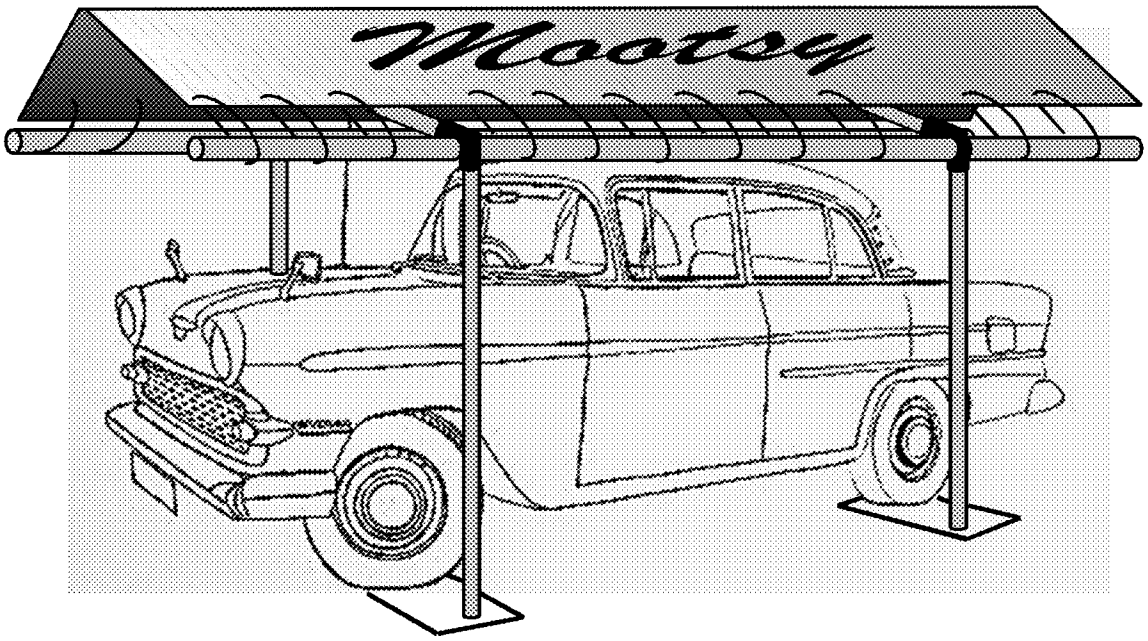
FIG. 2 shows a front perspective of a vehicle positioned in an embodiment with tires located on the tire plates or "paws."
Figure 3:
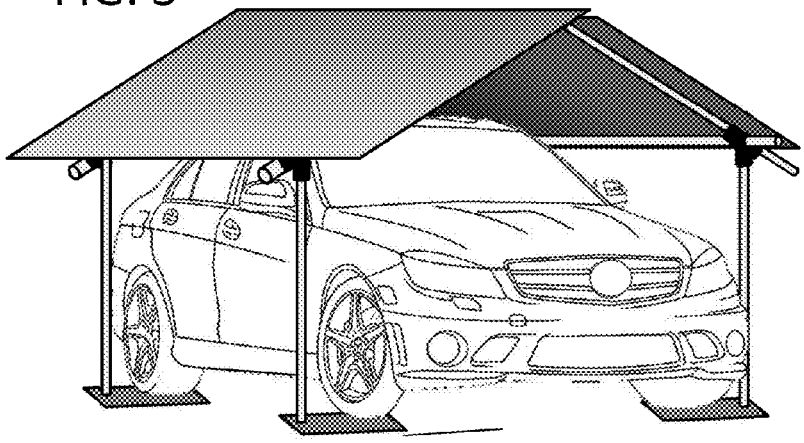
FIG. 3 shows a rear perspective showing a vehicle positioned in an embodiment with tires located on the tire plates or "paws."
Figure 4:
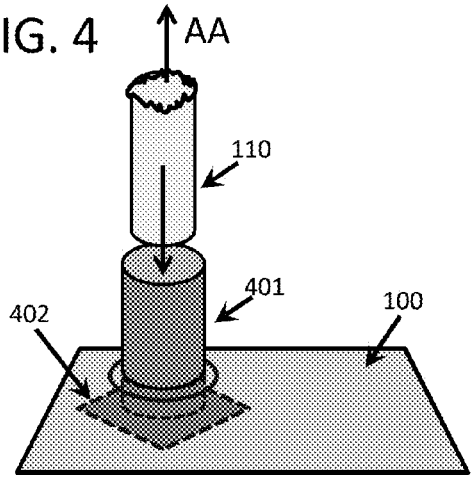
FIG. 4 describes an embodiment of the anchor element 102, which comprises a paw which can be positioned under the vehicle, a vertical, tubular foot element, or foot pad, which connects to the vertical element, and an optional locking mechanism.

A first embodiment of the carport frame 10 is shown in FIG. 1. The carport frame 10 is secured and stabilized by four anchor elements, 102, which comprise a tire plate, or "paw," 100, that is aligned under the wheels of a vehicle placed in the carport and a foot pad, 101 (FIG. 2 and FIG. 3). The foot pad, 101, may be connected to the paw, for example via welds, screws, bolts, etc. or may separate from the paw. For example, as shown in FIG. 4, the foot pad, 101, may comprise a tubular element, 401, connected to a small base plate, 402. In this embodiment, the paw 100 has a hole slightly larger than the tubular element, 401, which allows it to be laid on top of the foot pad and "lock" the footpad down with the weight of the vehicle. In some embodiments, the footpad and paw are "keyed" such that rotational movement of the paw can be limited to a certain angular range, e.g., 90° or 135° or, alternatively, so that rotational movement of the paw can be controlled by rotation of the foot pad around the axis formed by the vertical element 110.

Again looking at FIG. 1, linear elements 110, 130 (130 comprising 131 and 132), 140, and 160, can be made from any practical material, e.g. polymer, metal, wood, etc. However, due to cost, strength, and ease of use, metal tubing is typically used. In some embodiments, the metal tubing is circular tubing made of iron, steel, or aluminum. The tubing diameter can be chosen for the application, but iron pipe tubing of from 1-2" is typically sufficiently strong enough to provide the desired flexural strength and structural integrity needed in most carport applications, while still being sufficiently light enough to provide ease of transport and setup. Because one aspect of the design is to make the carport easily transportable, it is desirable in some embodiments to make the linear elements 110, 130, 131, 132, 140, and 160 sectionable into smaller sub-sections, or alternatively, the element is designed to telescope, or collapse to a length that is easily transportable in a standard automobile. In some embodiments, the linear elements 110, 130, 131, 132, 140, and 160, have a length no longer than about 6', 5', 4', or 3'.

Similarly, connector-type elements 120 and 150 can be made from any practical material, e.g. polymer, metal, wood, etc. However, again due to cost, strength, and ease of use, metal is most convenient. In some embodiments, the connector elements 120 and 150 are made of the same material as the linear elements 110, 130, 140, and 160. In cases where the linear elements 110, 130, 140, and 160 slide into or over the connector elements 120 and 150, the size of the connector elements 120 and 150 is chosen to provide a snug fit without binding—such as 0.1" larger or smaller. Either the linear elements 110, 130, 140, and 160 or the connector elements 120 and 150 may further incorporate mechanisms to lock the elements together. For example, the linear elements 110, 130, 140, and 160 may slide into one or more connector elements 120 and 150 and optionally, be locked in place by a set screw, bolt, screw, pin, clamp, or spring-loaded "button-type" apparatus, or the like. Alternatively, the linear elements 110, 130, 140, and 160 may slide over one or more connector elements 120 and 150 and be optionally secured via similar devices. In still another embodiment, connector elements 120 and 150 and foot pad 101 may be integrated into or part of one or more of the linear elements 110, 130, 131, 132, 140, and 160 they connect or connect to.

Looking again at FIG. 1, each foot pad, 101, is attached to a vertical element, 110. Attachment between the vertical element, 110, and the footpad 101, may be through any number of possibilities known to one of skill in the art. For example, the vertical element may slide into the footpad and optionally, be locked in place by a set screw, bolt, screw, pin, clamp, or spring-loaded "button-type" apparatus, or the like. Alternatively, the vertical element may slide over the footpad and be optionally secured via similar devices. Still another possibility is that vertical element, 110, and footpad, 101, screw together.

Figure 5:
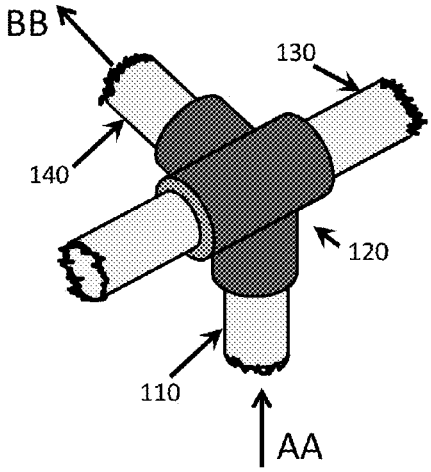
FIG. 5 shows an embodiment of the connector element which connects the transverse element to the rafter element and the vertical element.

Continuing to look at FIG. 1, vertical element, 110, attaches to transverse element 130 via connecting element 120. Connecting element 120 comprises an element that is capable of linking vertical element 110 to transverse element 130 (for sake of clarity, transverse element 130 as described in FIG. 1 does not include elements 120), and optionally to rafter element 140. In some embodiments, for example as shown in FIG. 5, connecting element 120 comprises a sleeve-type, two-, three-, or four-tube connector, a two-, three-, or four-tube threaded connector, a clamp-type apparatus, a strap, a latching apparatus, or the like. Generally, vertical element 110 slides into or over connecting element 120 and is secured via methods known in the art, such as by a set screw, bolt, screw, pin, clamp, or spring-loaded "button-type" apparatus, or the like.

Transverse element 130 can comprise one continuous element that is optionally sectionable into smaller sub-sections, or alternatively, the element is designed to telescope, or collapse to a length that is easily transportable. In some embodiments, the transverse element 130 does not continue through connecting element 120, but rather threads or locks into it, or butts up against an internal component of it. For example, transverse element 130 may comprise one or more outer transverse element sections 131 that attach to the connecting element 120 and one or more inner transverse element sections 132 that join two connecting elements 120. In some embodiments, outer and inner transverse elements, 132 and 131, respectively, slide into or over connecting element 120 or screw into connecting element 120, and can be secured to connector 120 via methods known in the art, such as by a set screw, bolt, screw, pin, clamp, or spring-loaded "button-type" apparatus, or the like.

Alternatively, in some embodiments, the transverse element 130 is a continuous element that passes through connector element 120 and may optionally be made of smaller subsections. In cases where transverse element 130 comprises smaller subsections, these subsections may slide together, screw together, or lock together through methods known to those skilled in the art, such as set screw, bolt, screw, pin, clamp, or spring-loaded "button-type" locking apparatus. When transverse element 130 is continuous, connecting element 120 is designed to clamp or lock around it. In some embodiments, the clamping or locking mechanism can be, for example, a set screw, bolt, screw, pin, spring-loaded "button-type" apparatus, a clamp-type apparatus, a strap, a latching apparatus, or the like. In embodiments where the transverse element 130 is continuous, the connecting element 120 in an unlocked or state may be traversable along the transverse element, 130. This is advantageous as it allows for movement of the vertical elements 110 to compensate for changes in vehicle length.

Figure 6:
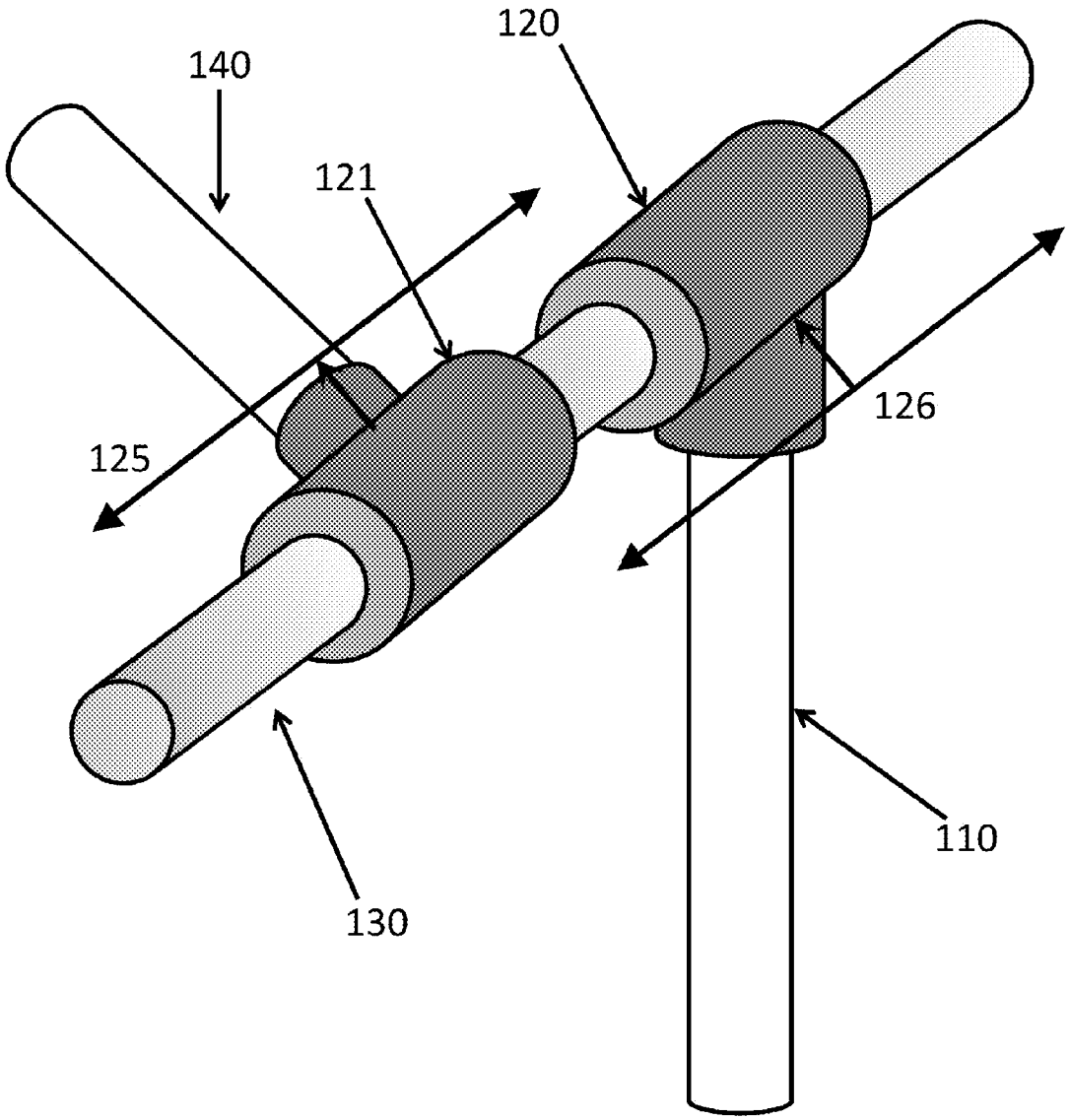
FIG. 6 is a schematic showing a close-in perspective of an alternative embodiment to FIG. 5, wherein of the transverse element connected to the vertical element and the rafter element via separate connectors.

As noted above, in some embodiments where the transverse element 130 is a continuous element, connecting element 120 is secured to the transverse element in a manner that allows it location to be varied. An example embodiment is shown in FIG. 6 where connecting element 120 can be moved as shown by arrow 126. Further, as shown in FIG. 6, when connecting element 120 only secures the vertical element 110 to the transverse element 130 (i.e., does not also secure the rafter element 140), the connecting element 120 (vertical-transverse connecting element) and the connecting element 121 (transverse-rafter connecting element) can move independently of each other (shown as arrows 126 and 125, respectively). Both connecting elements 120 and 121 may be secured to the transverse element 130 via a locking mechanism, a clamp mechanism, a strap mechanism, a set screw, or the like (FIG. 6, 610).

Rafter element, 140, as shown in FIGS. 1 and 6, may be attached to transverse element 130 via connector element 120 or via connector element 121. Generally, rafter element 140 slides into or over connector element 120 or connector element 121 and is secured via methods known in the art, such as by a set screw, bolt, screw, pin, clamp, or spring-loaded "button-type" apparatus, or the like. Alternatively, rafter element 140 may screw or thread into connecting elements 120 or 121.

Figure 7:
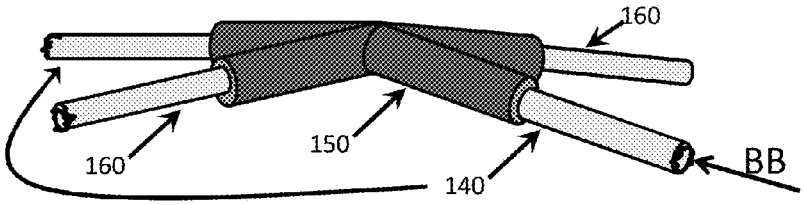
FIG. 7 shows an embodiment of the peak connector element which connects the peak element to the rafter elements.

Again, looking at FIG. 1, rafter element 140 connects to peak element 160 via peak connector element 150. Peak connecting element 150 comprises an element that is capable of linking rafter element 140 to peak element 160 (FIG. 1). In some embodiments, for example as shown in FIG. 7, peak connecting element 150 comprises a sleeve-type, two-, three-, or four-tube connector, a two-, three-, or four-tube threaded connector, a clamp-type apparatus, a strap, a latching apparatus, or the like. Generally, rafter element 140 slides into or over peak connecting element 150 and is secured via methods known in the art, such as by a set screw, bolt, screw, pin, clamp, or spring-loaded "button-type" apparatus, or the like.

Peak element 160 is similar to transverse element 130 and can comprise one continuous element, that is optionally sectionable into smaller sub-sections, or alternatively, the element is designed to telescope, or collapse to a length that is easily transportable. In some embodiments, peak element 160 does not continue through peak connecting element 150, but rather threads or locks into it, or butts up against an internal component of it. For example, as described above for transverse element 130, peak element 160 may comprise inner and outer sections that connect to peak connecting element 150. Outer and inner peak elements can be secured to peak connector 150 via methods known in the art, such as by a set screw, bolt, screw, pin, clamp, or spring-loaded "button-type" apparatus, or the like.

Alternatively, in some embodiments, the peak element 160 is a continuous element that passes through peak connector element 150 and may optionally be made of smaller, subsections. In cases where peak element 160 comprises smaller subsections, these subsections may slide together, screw together, or lock together through methods known to those skilled in the art, such as set screw, bolt, screw, pin, clamp, or spring-loaded "button-type" locking apparatus. When peak element 160 is continuous, peak connecting element 150 is designed to clamp or lock around it. In some embodiments, the clamping or locking mechanism can be, for example, a set screw, bolt, screw, pin, spring-loaded "button-type" apparatus, a clamp-type apparatus, a strap, a latching apparatus, or the like. In embodiments where the peak element 160 is continuous, the peak connecting element 150 in an unlocked or state may be traversable along the peak element, 160.

As noted above, in some embodiments where the peak element 160 is a continuous element, peak connecting element 150 is secured to the peak element 160 in a manner that allows it location to be varied. Similar to that shown for peak transverse element 150 in FIG. 1, peak connecting element 150 can be moved relative to peak element 160. Additionally, while FIG. 1 shows two rafter elements 140 attached to the Peak element via a single peak connecting element 150, an acceptable alternative is for each rafter element 140 to attach to the peak element 160 by its own peak connector element 150. In such an embodiment, the example four rafter elements 140 in FIG. 1 would attach to the peak element by four peak connector elements. Such a design may be advantageous in some cases where staggered rafter elements would be preferred. In all cases, rafter element 140 and peak element 160 may be secured to the peak connector element 150 via a locking mechanism, a clamp mechanism, a strap mechanism, a set screw, or the like.

The roof material can be made from any practical material, e.g. polymer, fabric, metal, wood, etc. However, due to cost, strength, and ease of use, a polymer, fabric, or polymer/fabric blend, such as in a tarpaulin, is ideal. Specific materials include polyethylene, canvas, vinyl, silnylon, nylon, cotton, etc. Thickness of the material can influence strength and weather resistance. For example, materials for the roof can be from ~5 mils to over 16 mils in thickness. Attachment of the roof to the frame 10 can be done via a number of mechanisms. The roof material can have grommets incorporated into its material, which are then used to connect the roof to the frame 10 via cables, ties, elastic bands, rubber straps, metal clasps, elastic cord ball ties, etc. Alternatively, some embodiments may have hooks or other latching elements on one or more of the transverse element 130, the vertical element 110 or the connector element 120. These optional latching elements can be used directly connect to the roof or may provide a latching point for cables, ties, elastic bands, rubber straps, metal clasps, etc. to latch to the frame 10.

As noted above, the present design is easily transportable and provides protection for vehicles from the elements. Further, because the design utilizes the car's own weight to stabilize and secure the frame, it doesn't need to be secured to the ground via cables, stakes, sandbags, or other mechanisms.

Example 1

FIG. 8 provides an example of one embodiment described herein. The dimensions of the various elements and the example materials are detailed in Table 1:

TABLE 1

| Label | Element Name | Number of Pieces | Dimensions | Material |
|---|---|---|---|---|
| A | Roof rafter | 4 | 4' × 1" (dia) | Iron pipe |
| B | Anchor plate | 4 | 10" × 24" × 0.125" | Aluminum plate |
| C | Inner transverse element | 2 | 9.4' × 1" (dia) | Iron pipe |
| C' | Inner peak element | 1 | 9.4' × 1" (dia) | Iron pipe |
| D | Vertical element | 4 | 6' × 1" (dia) | Iron pipe |
| E | Foot pad | 4 | 6" × 4" × 10" | Iron pipe/ plate |
| F | Outer transverse element | 4 | 4' × 1" (dia) | Iron pipe |

TABLE 1-continued

| Label | Element Name | Number of Pieces | Dimensions | Material |
|---|---|---|---|---|
| F' | Outer peak element | 2 | 4' × 1" (dia) | Iron pipe |
| G | End cap | 6 | 2" × 1.1" | polymer |
| H | Peak connector | 2 | 12" × 4" | Iron pipe fitting |
| I | Vertical connector | 4 | 12" × 12" | Iron pipe fitting |
| J | Elastic ball ties | 20 | 6" | Elastic polymer/ polymer |

The embodiment comprises four anchor plates, B, made of "diamond plate" aluminum with aluminum, iron, or steel tubing foot pad, E, to connect to the cast iron vertical "leg" elements, D. The legs can be cut to any desired length, but it is recommended that with side heights greater than 8', the tubing diameter should be increased to at least1⅜". In the case where the legs are longer than 5', it is advantageous for portability to have each leg composed of several sections that are able to be connected together via typically known means, such as sleeving, clips, set screws, screw threads, etc. The legs attach to the transverse elements, also described as the outer and center roof ridges, C and F, via a four-sleeve, cast iron pipe fitting, labeled as a vertical connector, I. The I pipe fitting is a modified T-shape with an additional connector angled to the pitch of the roof (see also FIG. 5).

Each I connects a leg element to two sections of the transverse element, an outer transverse element, F, and an inner transverse element, C. In the case where the transverse element is longer than 5', it is advantageous for portability to have each transverse element composed of several sections that are able to be connected together via typically known means, such as sleeving, clips, set screws, screw threads, etc. The outer and inner transverse elements, F and C may be secured to the connector element I via a set screw or, if threaded, by screwing into the connector. Alternatively, if the connector element is oversized, the roof ridge elements may be connected to each other via set screw, screw threads, sleeving, etc., and the connector element simply connects the roof ridge to the legs. Outer transverse elements may be fitted with end caps, G, made of any material, but advantageously from a material such as rubber or plastic.

Connector I is further linked to the roof rafters, A, which attach to the peak connector element, H, in this embodiment a four-sleeve pipe fitting. The peak connector element H connects two roof rafters, A, and outer and inner peak elements, C' and F'. As in the case of the transverse elements, the peak elements may be secured to the connector element H via a set screw or, if threaded, by screwing into the connector. Alternatively, if the connector element is oversized, the peak elements may be connected to each other via set screw, screw threads, sleeving, etc., and the peak connector element, H, simply connects the peak elements to the rafters, A.

Over the entire roof area is placed a tarp made of plastic, fabric or other weatherproof material. The tarp may have eyelets and can be secured via any ordinary means, such as ties, hook and eye, screws, bolts, etc. (FIG. 2, 210). In some cases, especially where there is the chance of severe weather conditions, plastic of fabric, or other weatherproof material may be added as side, front and rear "walls." As with the roof, the walls may have eyelets and can be secured via any ordinary means, such as ties, hook and eye, screws, bolts, etc.

The overall dimensions of the embodied car port are listed in Table 2:

TABLE 2

| | |
|---|---|
| Tarp size | 17.4' × 8' |
| Peak height | 6.5' |
| Side height | 6' |
| Front opening width | 8' × 6.5' |
| Tarp color | Optional |
| Overall length | 17.8' |

What is claimed is:

1. A carport comprising:

a. no more than four anchor plates, each anchor plate comprising a separate foot pad and a tire plate having a hole, wherein the foot pad inserts through the hole in the tire plate and the tire plate is rotatable around an axis formed by a vertical element;

b. no more than four vertical elements connected to the four anchor plates;

c. a roof structure covering substantially all of a vehicle on the four tire plates, comprising:

i. two transverse elements that are approximately parallel to each other and the ground and extending beyond the four vertical elements;

ii. a single peak element that is approximately parallel to the transverse elements and the ground and extending beyond the four vertical elements;

iii. six connecting elements, wherein a. two of the connecting elements are peak connecting elements, each of which connects the peak element to at least one transverse element via a rafter element; and b. four of the connecting elements are transverse connecting elements, each of which connects a transverse element to a vertical element.

2. The carport of claim 1, wherein the transverse elements, the peak element, or the vertical elements are able to be disassembled into sub-sections of length no greater than six feet.

3. The carport of claim 1, wherein the transverse elements, the peak element, or the vertical elements are able to be collapsed into lengths no greater than six feet.

4. The carport of claim 1, wherein the transverse connecting elements further connect the transverse element to the rafter element.

5. The carport of claim 1, wherein the peak connecting elements each connect the peak element to the two transverse element via two rafter elements.

6. The carport of claim 1, wherein the tire plates are able to be rotated over an angle of about 135 degrees or less.

7. The carport of claim 1, wherein the roof pitch is from about 1/12 rise/run to about 18/12 rise/run.

8. The carport of claim 7, wherein the roof pitch is from about 4/12 rise/run to about 12/12 rise/run.

9. The carport of claim 1, wherein the carport further comprises a roof element comprising a sheet of fabric, plastic or combination thereof.

10. The carport of claim 9, wherein the roof element is attached to the transverse elements by wire, flexible or fixed ties, rope, zip ties, buttons, zippers, or hook and eye elements.

11. The carport of claim 1, wherein the transverse elements or vertical elements slide into or over the transverse connector elements.

12. The carport of claim 1, wherein the peak element or rafter elements slide into or over the peak connector elements.

13. The carport of claim 1, wherein the transverse connecting element comprises a sleeve element having a sleeve structure with openings for the vertical element or the transverse element.

14. The carport of claim 1, wherein the transverse connecting element comprises a sleeve element having a sleeve structure with openings for the rafter element or the peak element.

15. The carport of claim 1, wherein the connecting elements further comprise a locking mechanism.

16. The carport of claim 15, wherein the locking mechanism comprises one or more of a set screw, bolt, screw, pin, clamp, or spring-loaded "button-type" apparatus.

17. The carport of claim 1, wherein the anchor plates comprise aluminum, and the vertical elements, the transverse elements, the peak element, and the connecting elements, and the first and second sleeve elements all comprise aluminum, steel, iron, plastic, fiberglass or carbon fiber.

* * * * *